US006293127B1

(12) United States Patent
Nakagawa

(10) Patent No.: US 6,293,127 B1
(45) Date of Patent: Sep. 25, 2001

(54) ROTATION PREVENTING NECKLACE

(75) Inventor: Shigeki Nakagawa, Tokyo (JP)

(73) Assignee: Nakagawa Corporation, Tokyo (JP)

( * ) Notice: Subject to any disclaimer, the term of this patent is extended or adjusted under 35 U.S.C. 154(b) by 0 days.

(21) Appl. No.: 09/331,586

(22) PCT Filed: Oct. 28, 1998

(86) PCT No.: PCT/JP98/04874

§ 371 Date: Jul. 1, 1999

§ 102(e) Date: Jul. 1, 1999

(87) PCT Pub. No.: WO99/25215

PCT Pub. Date: May 27, 1999

(30) Foreign Application Priority Data

Nov. 13, 1997 (JP) ..... 9-329423
Oct. 15, 1998 (JP) ..... 10-8107

(51) Int. Cl.[7] ..... A44C 5/00

(52) U.S. Cl. ..... 63/3; 63/4; 63/33; 63/34; 63/38; 59/80

(58) Field of Search ..... 63/3, 4, 33, 34, 63/38; 59/2, 80

(56) References Cited

U.S. PATENT DOCUMENTS

| | | | | |
|---|---|---|---|---|
| 430,295 | * | 6/1890 | Mathewson | 63/3 |
| 1,375,176 | * | 4/1921 | Richards | 63/3.1 |
| 1,578,461 | * | 3/1926 | Morris | 63/3.1 |
| 3,091,030 | * | 5/1963 | Zumbrunnen | 29/460 |
| 4,095,587 | * | 6/1978 | Ishikawa | 600/15 |
| 4,718,252 | * | 1/1988 | Fossas | 210/521 |
| 5,125,225 | * | 6/1992 | Strobel | 59/35.1 |
| 5,279,132 | * | 1/1994 | Swaim | 63/3.1 |
| 5,592,835 | * | 1/1997 | Herr | 63/4 |

* cited by examiner

*Primary Examiner*—B. Dayoan
*Assistant Examiner*—Andrea Chop
(74) *Attorney, Agent, or Firm*—Oblon, Spivak, McClelland, Maier & Neustadt, P.C.

(57) ABSTRACT

A necklace which prevents rotation. The necklace has a connecting metal positioned on the rear side which is prevented from being turned to the front when it is worn. The necklace includes a plurality of continuously arranged pieces with connecting metals provided at opposite ends of the pieces. At least one piece among the plurality of pieces in the proximity of the connecting metals is formed of a hollow member while the other pieces are formed of solid members.

17 Claims, 5 Drawing Sheets

ROTATION PREVENTING NECKLACE

FIELD OF THE INVENTION

The present invention relates to a necklace, in particular, one wherein connecting metal fittings of the necklace to be positioned on the rear side of neck is prevented from appearing on the front side with turning around the neck.

DISCUSSION OF THE BACKGROUND

Generally, a necklace comprises unit: pieces (koma in Japanese) arranged successively to make a chain and connecting metal fittings attached at both ends thereof, and is a personal ornament, which is used by hanging around neck and by connecting the connecting metal fittings at both ends between themselves.

When wearing such necklace, in particular, with a necklace successively arranged a lot of similarly shaped pieces made from the same material, a necklace structured so that the portion of connecting metal fittings is relatively heavier than the portion of pieces, or the like, it often ended up to turn naturally around neck on wearing and the portion of connecting metal fittings come to move to the front side of neck, thus giving an unseemly impression as a personal ornament.

As a result of various investigations to solve such inconvenience, the invention provides a necklace that does not end up to turn around neck on wearing.

SUMMARY OF THE INVENTION

Namely, the invention provides a rotation-preventive necklace characterized in that, in the necklace successively arranged a plurality of pieces and provided with connecting metal fittings at both ends, at least one or more of pieces neighboring said connecting metal fittings are formed with hollow members and other pieces are formed with solid members. And, it is effective to form all pieces with the same material and in the same shape, or to use pieces having different shapes of plural types repeatedly in turn, respectively. Further, it is effective to form the respective pieces locating in the middle portion of necklace being less than approximately ⅓ of the overall length of necklace with solid members and the respective pieces locating in the portion of both ends of said necklace being less than approximately ⅓ of the overall length of necklace with hollow members. Moreover, it is also effective to use metal as a prime material of pieces.

Moreover, other rotation-preventive necklace of the invention is characterized in that, in the necklace successively arranged similarly shaped pieces and provided with connecting metal fittings at both ends, the weight of pieces neighboring connecting metal fittings is made lighter than the weight of pieces in the middle portion.

Moreover, other one of the invention is a rotation-preventive necklace characterized in that, in the necklace successively arranged a plurality of similarly shaped ring-like pieces by joining them each other and provided with connecting metal fittings at both ends, the pieces neighboring connecting metal fittings are formed with pipe material and the pieces in the middle portion are formed with solid material of the same material as that of said pipe material. At this time, it is effective to fill a substance lighter than said pipe material, for example, aluminum, wax or resin inside the pipe material in the case of pipe material being gold, silver, brass or the like that is the quality of material used commonly for the personal ornament.

Moreover, other one of the invention is a rotation-preventive necklace characterized in that, in the necklace successively arranged a plurality of similarly shaped ring-like pieces by joining them each other and provided with connecting metal fittings at both ends, the pieces neighboring connecting metal fittings are formed with a pipe material filled inside by a filler of light weight and the pieces in the middle portion are formed with the pipe material filled inside by a filler of heavy weight which is heavier than said filler of light weight. At this time, it is good to use heavy metal such as lead or copper as the filler of heavy weight in the case of the filler of light weight being light metal such as aluminum, wax or resin, but, in short, it is only necessary that weight of the filler in pieces of the middle portion is greater than weight of the filler in pieces neighboring connecting metal fittings.

Furthermore, other one of the invention is a rotation-preventive necklace characterized in that, in the necklace successively arranged a plurality of similarly shaped hollow pieces by joining them each other and provided with connecting metal fittings at both ends, the pieces in the middle portion is plated thereon more thickly than pieces neighboring connecting metal fittings.

DETAILED DESCRIPTION OF THE PREFERRED EMBODIMENTS

EXAMPLE 1

Figure 1:
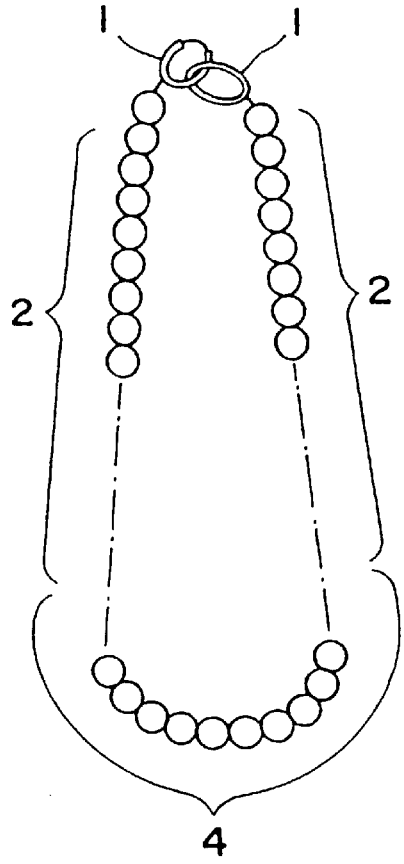
FIG. 1 is a front view showing the necklace in Example 1 of the invention.
Figure 2:
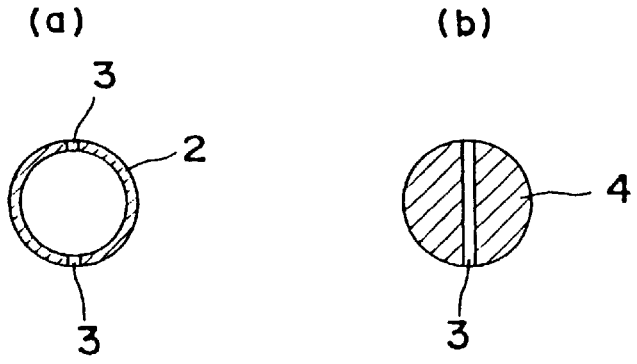
FIG. 2(*a*) is a side sectional view showing the hollow member in FIG. 1 and FIG. 2(*b*) is a side sectional view showing the solid member similarly.

A necklace successively arranged brassy spheres by threading of a center thread and provided with connecting metal fittings (1)(1) at both ends, respectively, as shown in FIG. 1 was fabricated. The pieces neighboring connecting metal fittings of this necklace, that is, pieces (2)(2) locating in a length up to about ⅓ of the overall length of said necklace from both ends of said necklace, respectively, are hollow spheres having a shape with passing holes (3) of center thread pierced up and down, as in FIG. 2(*a*), and pieces (4) locating in the middle portion of said necklace being in the portion of a length of about ⅓ of the overall length of said necklace are solid spheres having a shape with passing holes of center thread pierced through, as in FIG. 2(*b*).

With such necklace on wearing around neck, the front side, that is, the underside is always heavier, hence, even if said necklace may be worn for a long time or may be undergone vibration, it does not end up to turn around neck.

While all pieces have the same shape in this example, also with a necklace using pieces having different shapes of plural types repeatedly in turn, respectively, it can be intended similarly to prevent the rotation of said necklace around neck of the wearer by constructing the pieces neighboring connecting metal fittings with hollow members.

Moreover, the extent of length over which the middle portion of necklace is practically constructed with solid members can be determined appropriately depending on the weight of connecting metal fittings that locate oppositely, quality of material, specific gravity, weight, etc. of each piece.

EXAMPLE 2

Figure 3:
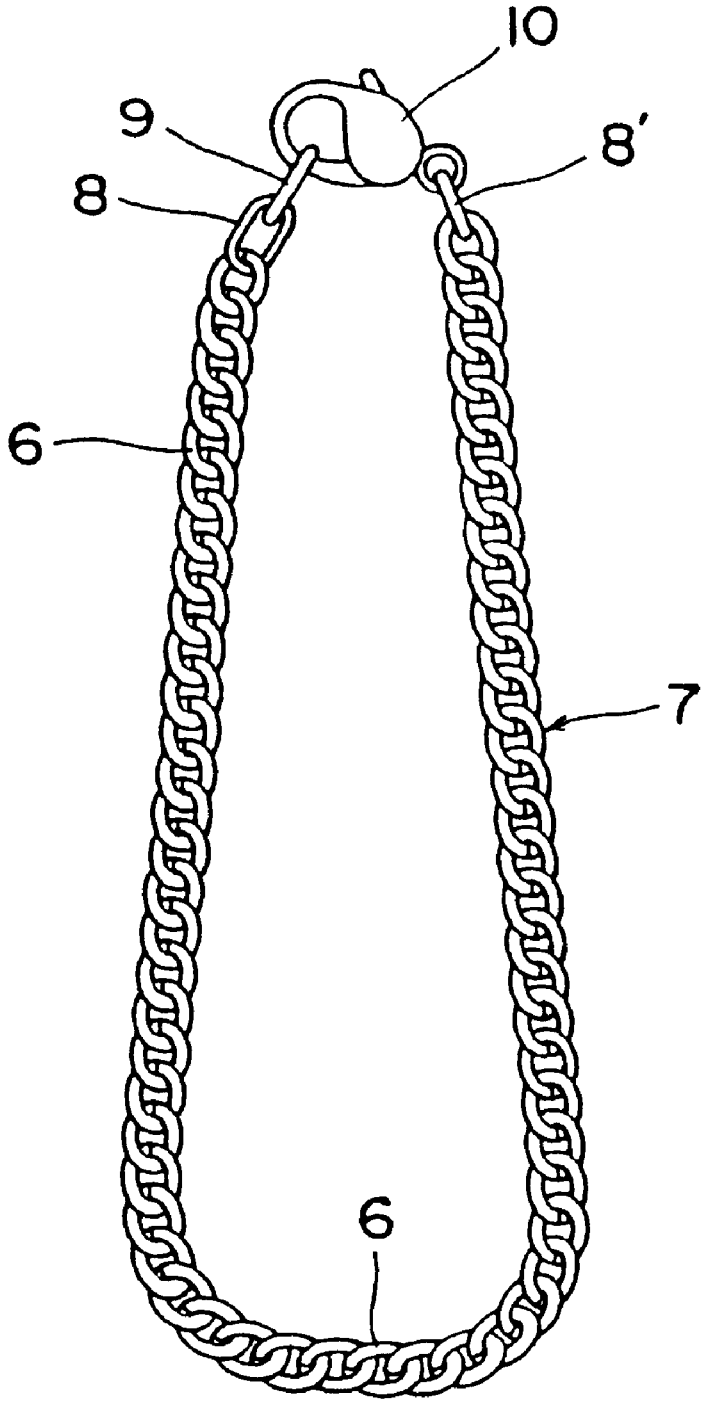
FIG. 3 is a front view showing one example of necklace used Kihei (proper noun in Japanese) chain.
Figure 7:
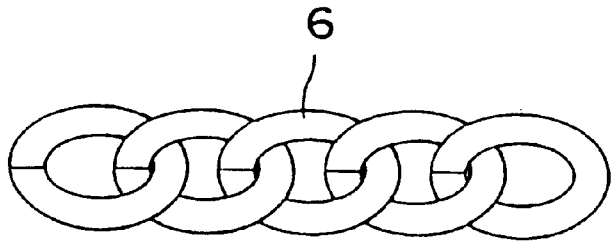
FIG. 7 is a front view showing Kihei chain.
Figure 8:
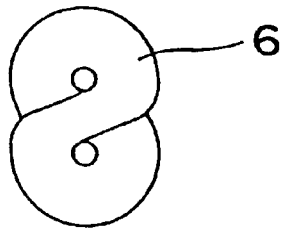
FIG. 8 is a side view showing a piece of Kihei chain.

FIG. 3 shows a necklace used Kihei chain. The Kihei chain is made in such a way that a piece (6) molded a round bar (5), for example, with the quality of material of gold into ring-like shape as shown in FIG. 9 is connected in turn as shown in FIG. 7 and all of those connected ring-like pieces (6) are twisted in the same direction to give the twisting deformation to each piece (6), thereby producing a plate-shaped chain that was twisted in the same direction around on axis along connecting direction, as shown in FIG. 8.

Figure 4:
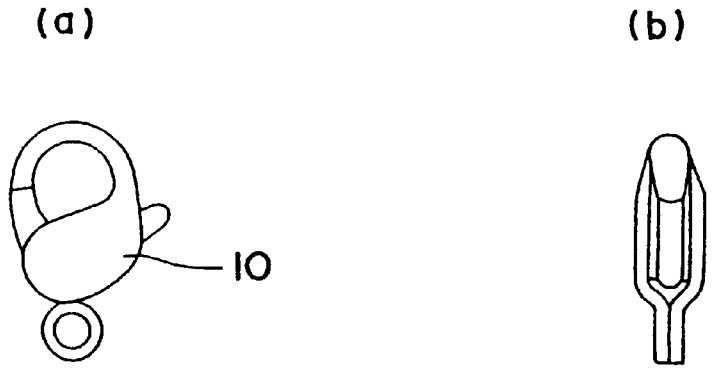
FIG. 4 shows a clasp of the parts of fastening metal fittings, wherein (a) is a front view and (b) is a side view.
Figure 5:
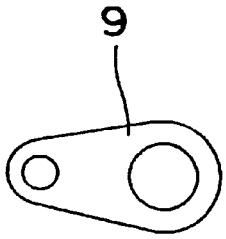
FIG. 5 is a front view showing a plate of the parts of fastening metal fittings.
Figure 6:
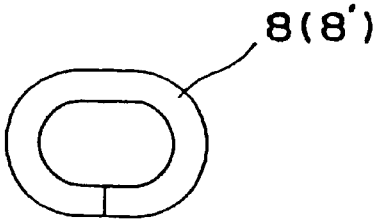
FIG. 6 is a front view showing a connecting ring.

And, one example of this Kihei chain processed to necklace is shown in FIG. 3. Namely, connecting rings (8)(8') as in FIG. 6 are attached to both ends of Kihei chain (7), a plate (9) in FIG. 5 being one of the parts of fastening metal fittings is attached to one connecting ring (8) and a clasp (10) in FIG. 4 being another of the parts of fastening metal fittings is attached to other connecting ring (8') to make necklace.

Figure 9:
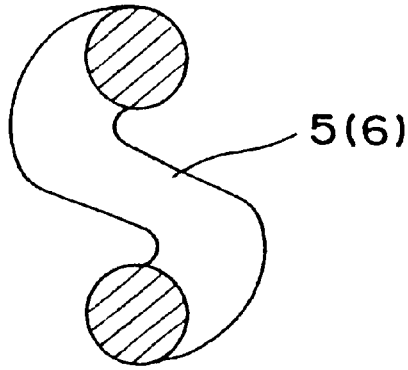
FIG. 9 is a sectional view showing a solid piece of Kihei chain used round bar.
Figure 10:
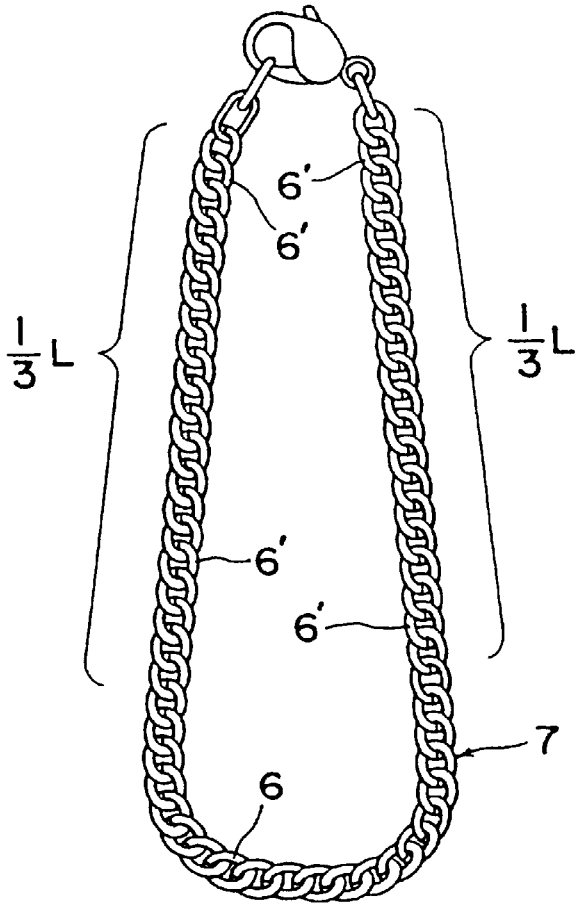
FIG. 10 is a front view showing the necklace in Example 2 of the invention.
Figure 11:
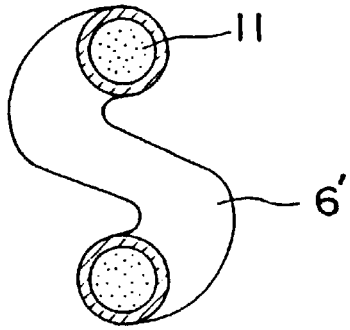
FIG. 11 is a sectional view showing a ring-like piece consisting of hollow pipe material filled with aluminum to be used for the Kihei chain of necklace in FIG. 10.

In the necklace used such Kihei chain, in the invention, pieces of hollow gold pipe with aluminum alloy (11) filled inside as shown in FIG. 11 were used for the ring-like pieces (6') over a length of about ⅓ of the overall length L from both ends of Kihei chain (7), respectively, and solid material of gold in FIG. 9 was used over about (⅓) L in the middle portion, as shown in FIG. 10. The reason why such ring-like pieces (6') filled inside with the filling material lighter than the pipe material are used is that, by filling said aluminum, resin or others, it is possible to prevent the hollow gold pipe from being collapsed at bending portion when making said ring-like pieces by bending processing, furthermore it is possible to leave behind this filler inside thereof, thus enabling to omit the process to dissolve and remove this filler by solvent, heating or the like after processed said pipe material to aiming shape. Yet, by using the substance with specific gravity lower than that of pipe material as a filler, in the necklace having a construction as shown in FIG. 10, the neighborhood of fastening metal fittings becomes relatively light and the lower portion becomes heavier than the upper portion on wearing, thus making it also possible to solve the problem that the necklace ends up to turn around neck during wearing.

In this example, an example of Kihei chain was shown, but any other type of chain may be used for necklace, and chains used pieces wherein the inside of pieces neighboring connecting metal fittings is hollow, pieces wherein the specific gravity of the material of said pieces is lower than that of the material of pieces in the middle portion of chain, and the like can be used.

And, when using ring-like pieces as in the example afore-mentioned, those filled inside with light weight material are good to prevent the collapse of section on molding processing. Moreover, the sectional shape of such ring-like pieces may be any shape of ellipse, rectangle and the like in addition to circle as in FIG. 11.

EXAMPLE 3

When making the necklace comprising Kihei chain as in FIG. 3, using similarly shaped ring-like pieces, all of which consist of gold pipe material, aluminum was filled in the pieces neighboring both sides of connecting metal fittings and lead was filled in the pieces in the middle portion.

With such necklace, too, the neighborhood by connecting metal fittings is relatively of lighter weight than middle portion, hence said necklace never ends up to turn around neck on wearing.

EXAMPLE 4

In the necklace to be made by successively arranging a lot of plated spherical pieces, thicker plating is given for the pieces to be arranged in the middle portion than for the pieces neighboring connecting metal fittings. With such construction, the middle portion becomes relatively heavier than the sides of connecting metal fittings, hence it is possible to prevent the rotation of said necklace around neck during wearing.

Possibility of Utilization in the Industry

As described, according to the invention, the nice-looking of necklace and good wearing property thereof can be obtained, since the inconvenience that the necklace turns around neck can be solved and the portion of connecting metal fittings is always on the rear side. In addition, when using ring-like pieces consisting of hollow pipe material as pieces, they can be utilized in the state of leaving behind the filler, which had been used at the time of molding processing, in said pieces as it is, hence the process to remove said filler can be omitted, leading to decreased manufacturing cost. Moreover, if using the pieces consisting of such pipe material or pieces consisting of hollow material, the amount of material to be used can be saved, resulting in significant effect particularly in the case of using noble metal materials.

What is claimed is:

1. A rotation-preventive necklace comprising:

a chain formed of a plurality of pieces arranged successively; and a connecting metal fitting provided respectively at each end of said chain;

wherein at least one of said plurality of pieces neighboring a respective one of said connecting metal fittings comprises a hollow member and all other ones of said plurality of pieces comprise a solid member.

2. The rotation-preventive necklace of claim 1, wherein said plurality of pieces all comprises the same material in the same shape.

3. The rotation-preventive necklace of claim 2, wherein:

the plurality of pieces comprises ones in a middle portion of said chain and other ones in end portions respectively located in each end of said chain;

said middle portion is less than approximately ⅓ of an overall length of said chain;

said ones of said plurality of pieces in a middle portion of said chain comprise a plurality of solid members; and said end portions each are less than approximately ⅓ of the overall length of said chain and said other ones of the plurality of pieces in end portions respectively located in each end of said chain comprise a plurality of hollow members.

4. The rotation-preventive necklace of claim 2, wherein said plurality of pieces comprises primarily metal.

5. The rotation-preventive necklace of claim 1, wherein said plurality of pieces comprises a plurality of members having different shapes arranged in repetition.

6. The rotation-preventive necklace of claim 5, wherein:

said chain has a middle portion which is less than approximately ⅓ of an overall length of said chain and an end portion which is less than approximately ⅓ of the overall length of said chain and provided respectively at each end of said chain; and said plurality of pieces comprises a plurality of solid members in said middle portion and a plurality of hollow members in said end portion at each end of said chain.

7. The rotation-preventive necklace of claim 5, wherein said plurality of pieces comprises primarily metal.

8. The rotation-preventive necklace of claim 1, wherein:

said chain has a middle portion which is less than approximately ⅓ of an overall length of said chain and an end portion which is less than approximately ⅓ of the overall length of said chain and provided respectively at each end of said chain;

said end portion of said chain comprises a plurality of hollow members.

9. The rotation-preventive necklace of claim 8, wherein said plurality of pieces comprises primarily metal.

10. The rotation-preventive necklace of claim 1, wherein said plurality of pieces comprises primarily metal.

11. A rotation-preventive necklace comprising:

a chain formed of a plurality of pieces all having the same shape and size and arranged successively; and a connecting metal fitting provided respectively at each end of said chain, wherein ones of said plurality of pieces neighboring a respective one of said connecting metal fittings at each end are made lighter than ones of said plurality of pieces in a middle portion of said chain.

12. A rotation-preventive necklace comprising:

a chain formed of a plurality of ring pieces all having the same shape and size; and a connecting metal fitting provided respectively at each end of said chain, wherein the plurality of ring pieces comprises a plurality of pipe pieces neighboring a respective one of said connecting metal fittings and a plurality of solid pieces in a middle portion of said chain, and said plurality of pipe pieces and said plurality of solid pieces comprise the same material.

13. The rotation-preventive necklace of claim 12, wherein said plurality of pipe pieces is filled with a substance lighter than said plurality of pipe pieces.

14. The rotation-preventive necklace of claim 13, wherein the substance lighter than said plurality of pipe pieces comprises one of aluminum, wax and resin.

15. A rotation-preventive necklace comprising:

a chain formed of a plurality of ring pieces and having the same size; and a connecting metal fitting provided respectively at each end of said chain;

wherein:

the plurality of ring pieces comprises ones neighboring a respective one of said connecting metal fittings and other ones in a middle portion of said chain; and said ones of said plurality of ring pieces comprise a plurality of pipe members with light weight filler filled inside, and said other ones of the plurality of ring pieces in the middle portion comprise a plurality of pipe members with weight filler heavier than said light weight filler filled inside.

16. The rotation-preventive necklace of claim 15, wherein:

said weight filler heavier than said light weight filler filled inside comprises one of lead and copper; and said light weight filler comprises one of aluminum, wax and resin.

17. A rotation-preventive necklace comprising:

a chain formed of a plurality of hollow pieces all having the same shape and size arranged successively by joining; and a connecting metal fitting provided respectively at each end of said chain, wherein the plurality of hollow pieces comprises ones in a middle portion of said chain, and said ones of said plurality of hollow pieces are plated thicker than other ones of said plurality of hollow pieces neighboring a respective one of said connecting metal fittings.

* * * * *